United States Patent [19]

Altenhöfer et al.

[11] Patent Number: 4,504,533

[45] Date of Patent: Mar. 12, 1985

[54] GYPSUM CONSTRUCTION SHEET WITH GLASS FIBER/NON-WOVEN FELT LINING SHEET

[75] Inventors: Herbert Altenhöfer; Engelbert Wintzheimer, both of Iphofen; Gerhard Neuhauser, Würzburg, all of Fed. Rep. of Germany

[73] Assignee: Gebr. Knauf Westdeutsche Gipswerke, Iphofen, Fed. Rep. of Germany

[21] Appl. No.: 614,703

[22] Filed: May 29, 1984

Related U.S. Application Data

[63] Continuation of Ser. No. 246,263, Mar. 23, 1981, abandoned.

[30] Foreign Application Priority Data

Mar. 29, 1980 [DE] Fed. Rep. of Germany ..... 3012293

[51] Int. Cl.[3] ..... B32B 1/04; B32B 31/18

[52] U.S. Cl. ..... 428/70; 428/74; 428/77; 428/126; 428/127; 428/128; 428/129; 428/130; 428/193; 428/194; 428/236; 428/251; 428/285; 428/703

[58] Field of Search ..... 428/70, 74, 77, 126, 428/127, 128, 129, 130, 193, 194, 236, 251, 285, 703

[56] References Cited

U.S. PATENT DOCUMENTS 3,964,944 6/1976 Gwynne ..... 428/70

FOREIGN PATENT DOCUMENTS 2049603 8/1977 Fed. Rep. of Germany .

*Primary Examiner*—Marion E. McCamish
*Attorney, Agent, or Firm*—Holman & Stern

[57] ABSTRACT

The invention concerns a gypsum construction board in which a gypsum core is faced with a two-layer laminate comprised of a nonwoven fiber felt and a glass fiber web of crossed glass fibers wherein the glass fiber web of crossed glass fibers is embedded in the gypsum core and the laminate is in the form of a laminate sheet which extends across the width of the board.

2 Claims, 2 Drawing Figures

GYPSUM CONSTRUCTION SHEET WITH GLASS FIBER/NON-WOVEN FELT LINING SHEET

This is a continuation of application Ser. No. 246,263, filed Mar. 23, 1981, now abandoned.

The invention concerns a gypsum construction sheet in which a gypsum core is coated with a non-woven (mineral wool) layer and fiberglass mat composite wherein the fiberglass mat is embedded in the gypsum core and the composite is in the form of a web which extends across the width of the sheet.

From Ger. AS No. 20 49 603, such a gypsum construction sheet is known, which is manufactured on ordinary, exclusively horizontally operating equipment for gypsum sheet production. In the manufacturing process a relatively wide lower coating web is deposited on a conveyor belt, and the gypsum core is then formed on top of this. The two relatively wide border regions of the lower coating web are wrapped around the longitudinal edges of the gypsum core and placed on the upper side of the gypsum core. Then a coating web which is narrower than the lower coating web is placed on the upper side of the gypsum core so that its border regions lie on top of the wrapped-around regions of the lower coating web and are bonded adhesively to them. In this way a lower coating web is fashioned in which both the fiberglass mat and a non-woven fiberglass layer, such as glass wool, extend over the entire width; this produces difficulties and problems in the scoring necessary for wrapping-around the border regions, in the folding process, and thus in the adhesive bonding process, particularly when these are continuous operations. In the manner indicated above an upper coating web is fashioned in which both the fiberglass mat and the non-woven fiberglass layer extend over the entire width; consequently, ridges and undulations form, on the border regions which mutually overlap and are adhesively bonded together. These ridges and undulations are undesirable because they cause poor adhesion and detract from the desired smooth surface of the gypsum construction sheet.

SUMMARY OF THE INVENTION

Accordingly, an underlying problem of the invention is to devise a gypsum construction sheet which has a composite non-woven (mineral wool) layer and woven fiberglass mat construction, the gypsum sheet employing an improved fabrication technique, and which in particular is adhesively bonded. The inventive gypsum construction sheet which solves this problem is characterized in that the fiberglass mat is cut away in both longitudinal border regions of the composite web, i.e., is absent there.

References herein to a "fiberglass mat" in connection with the invention mean a woven fiberglass mat or a fiberglass fabric. The word "Glasseidengelege" used to name this layer in the German and PCT applications from which the U.S. specification claims priority is also used in German laid-open patent application No. 20 49 603, discussed above, to describe the structure of FIG. 1 thereof. References herein to a "non-woven (mineral wool) layer" mean a non-woven fabric made from mineral fibers or glass fibers, or mixtures of these two types of fiber. The mat and the layer are, thus, structurally different although they may be made of the same material. The inventive configuration of the composite web affords crucial advantages in the manufacture of the gypsum construction sheet, as will be made clear infra, and these advantages are associated with improved adhesive bonding on the upper side.

If a fiberglass mat and non-woven (mineral wool) layer composite web is provided underneath the gypsum core, with the border regions of said web being wrapped around the longitudinal edges of the gypsum core onto the upper side of the said core, the invention provides that the fiberglass mat is cut away on both folded-over border regions of the lower composite web along the bend line. In this way, scoring and folding of the lower composite web is greatly facilitated, which is important for a continuous, trouble-free manufacturing process. Under this arrangement, only the layer of non-woven material needs to be scored, folded, and wrapped around.

In the manufacture of the inventive gypsum construction sheet the same or nearly the same scoring wheels are used as in the fabrication of ordinary gypsum sheet, wherewith the elevation and separation distance of the scoring wheels must be set precisely. In the manufacture of the inventive gypsum construction sheet, however, only the non-woven (mineral wool) layer is scored; thus, a constant scoring depth is achieved, leading to uniform folding, i.e., an edge free of defects, and this in turn leads to a uniform adhesive bond on the upper side, free of defects. The situation is avoided wherein, due to excessive scoring, the border regions which are to be glued above sink downward into the gypsum core, causing defects in the adhesive bonding.

If a coating web is provided on the lower side of the gypsum core, with the border regions of said web being wrapped around the longitudinal edges of the gypsum core onto the upper side of said core, and if on the top side a fiberglass mat and non-woven (mineral wool) layer composite web is provided, with border regions overlapping the wrapped-around border regions and adhesively bonded to them, the invention provides that the fiberglass mat is cut away on both adhesively bonded border regions of the upper composite web, i.e., is absent there. By this means the adhesive bonding between the upper and lower composite webs is improved, since the adhesive locations are now smooth and unitary. If the lower coating is also a composite web, the smoothness of the adhesive locations is further improved if the wrapped-around border regions of the lower composite web are free of fiberglass mat, at least in the region of the adhesive locations.

Good bonding on the upper side is required not only for reasons of esthetics and smoothness but moreover for stability. Poor bonding at the edges reduces the strength of the adhesive bond, and may even lead to tearing and breaks in the edges of the sheet. Therefore it is important to avoid ridges and undulations. It is necessary, in order to achieve completely problem-free adhesive bonding between the upper and lower web, not only to avoid ridges and undulations, but also to have a continuously good fold of the lower web.

BRIEF DESCRIPTION OF THE DRAWINGS

The drawings depict a preferred embodiment of the invention.

DETAILED DESCRIPTION OF THE INVENTION

The gypsum construction sheet shown has a gypsum core in the shape of a sheet, made of a mixture of calcined gypsum, water, and, if necessary or desirable, additives, such as setting accelerators, air-pore formers, fibers, etc. The terms "upper" and "lower" used herein refer to the attitude in the manufacturing process for the construction sheet. When the construction sheet is being processed, the lower side is the viewing side and the upper side is the back side. To manufacture it the mixture is applied as a water-suspended paste to a lower coating web 2 which is wrapped around upward at the longitudinal sides. Then an upper coating web is applied on top of this and is adhesively bonded to it. The coating webs are dry and free of gypsum when they come into contact with the mixture.

Figure 1:
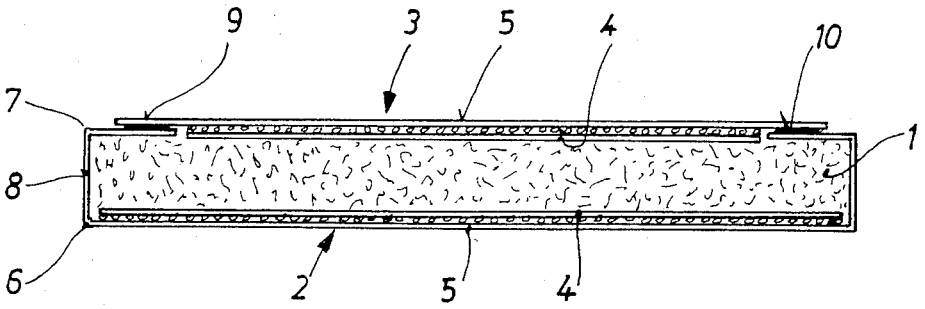
FIG. 1 shows the end face of a coated gypsum construction sheet, viewed along the long side.

The coating webs 2 and 3 each have a composite structure comprising a fiberglass mat 4 and a fiberglass non-woven layer 5. The non-woven layer 5 may alternatively be comprised of another mineral fiber, or may be a mixed non-woven material comprised of a number of materials, e.g., mineral fibers, glass fibers, and cellulose fibers. The fiberglass mat 4 is more or less deeply embedded in the gypsum core 1 on one of the main surfaces of said core, and has a mesh size which permits penetration of the above-mentioned mixture. The fiberglass non-woven layer 5 is an outer layer which prevents or hinders the passage of gypsum through it; the gypsum of the gypsum core may penetrate up to non-woven layer 5 or even slightly into it, however. Non-woven layer 5 is, e.g., adhesively bonded to mat 4. However, it is possible to form a composite structure in which the mat is located more or less deep inside the non-woven layer, or the fibers of the non-woven layer may be looped around the fibers of the mat. The mat is depicted only schematically in FIG. 1, with no indication of the correct position and orientation of the individual fibers.

Figure 2:
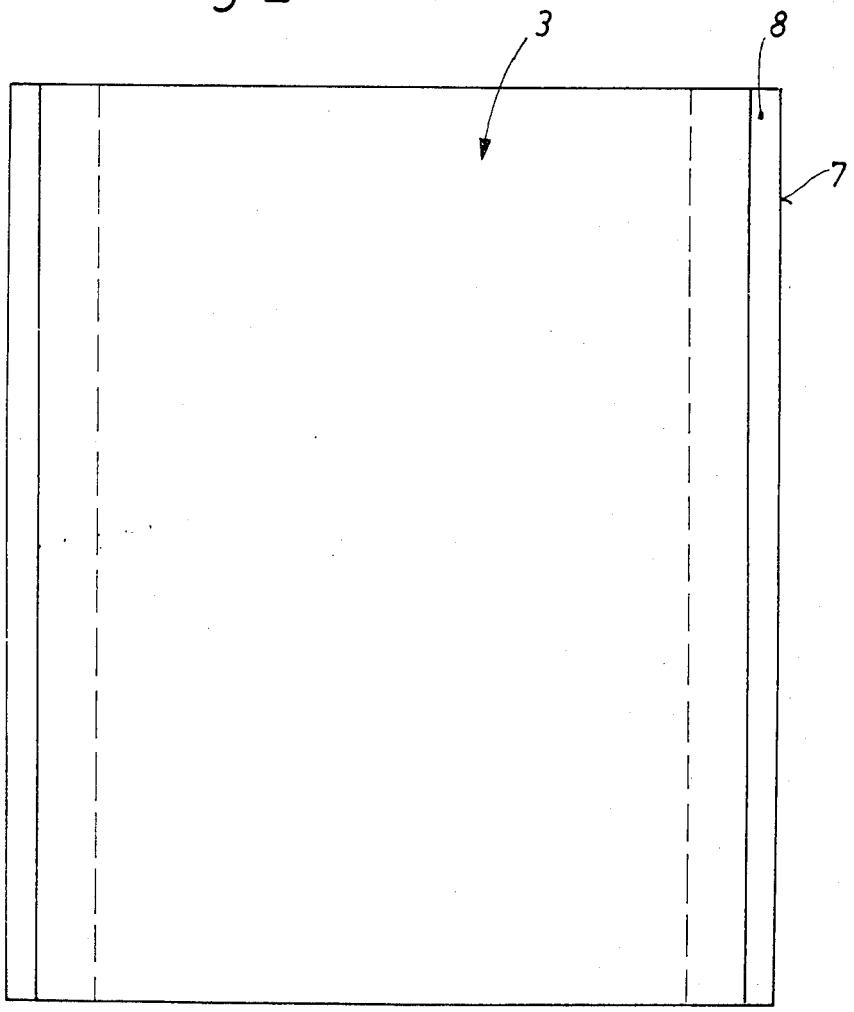
FIG. 2 is a top view of the gypsum construction sheet of FIG. 1.

The lower coating web 2 has 90° bend and scoring lines 6 and 7 along both the lower and upper sides of each of the two longitudinal sides, and is vertical at the lower scoring line 6 and folded back at the upper scoring line 7. The vertical and folded back region defines an edge region 8. Each side of the upper coating web 2 (border region 9) lies on top of the folded back region of the respective edge region 8 and is adhesively bonded to the latter by means of a layer of adhesive 10. The region of overlap of border region 9 of upper web 3 and edge region 8 of lower web 2 is thinned, since there is no mat 4 on the upper web 3 in the overlap region. This mat layer is disposed approximately in the plane in which the wrapped-around region of the non-woven edge region 8 of the lower web is disposed. The lower scoring line 6 runs a short distance away from and outside the terminal edge of the lower mat 4. The width of the cut out part of the mat is noticeably less on the upper web 3 than on the lower web 2 FIG. 2. In departure from FIG. 1, it is advantageous for the mats 4 of the two coating webs to be the same width, for reasons of cost savings in the manufacture of the composite webs.

What is claimed is:

1. A gypsum construction board comprising a gypsum core formed by application of a water paste like slurry of a mixture of calcined gypsum, water and operational additive on a gypsum-free, dry lower lining sheet folded over upward around longitudinal edges of said core on which is placed a narrower upper gypsum-free, dry lining sheet having margins overlapping the margins of the lower lining sheet, both margins being bonded adhesively and said upper and lower lining being a two-layer laminate of an inner glass fiber web and an outer non-woven fiber felt, said web being embedded in the gypsum core over the width of the board and the glass fiber web of the lower lining sheet being omitted at folded-over sides and edges.

2. A gypsum construction board according to claim 1, wherein the glass fiber web of the upper lining sheet is omitted at the adhesively bonded margins.

* * * * *